US011643175B2

(12) United States Patent
Araki et al.

(10) Patent No.: US 11,643,175 B2
(45) Date of Patent: May 9, 2023

(54) PERSONAL WATERCRAFT

(71) Applicant: KAWASAKI MOTORS, LTD., Akashi (JP)

(72) Inventors: Toshio Araki, Akashi (JP); Yu Shibuta, Kobe (JP); Kazunori Yamada, Kakogawa (JP)

(73) Assignee: KAWASAKI MOTORS, LTD., Akashi (JP)

( * ) Notice: Subject to any disclaimer, the term of this patent is extended or adjusted under 35 U.S.C. 154(b) by 213 days.

(21) Appl. No.: 17/127,320

(22) Filed: Dec. 18, 2020

(65) Prior Publication Data

US 2022/0194526 A1 Jun. 23, 2022

(51) Int. Cl.

| | |
|---|---|
| ***B63B 34/10*** | (2020.01) |
| ***B63B 3/48*** | (2006.01) |
| ***B63B 11/00*** | (2006.01) |
| ***B63H 25/02*** | (2006.01) |

(52) U.S. Cl.

CPC ..... *B63B 34/10* (2020.02); *B63B 3/48* (2013.01); *B63B 11/00* (2013.01); *B63H 25/02* (2013.01); *B63H 2025/024* (2013.01)

(58) Field of Classification Search

CPC ..... B63B 34/10; B63B 3/48; B63B 11/00; B63H 25/02

See application file for complete search history.

(56) References Cited

U.S. PATENT DOCUMENTS

| | | | | |
|---|---|---|---|---|
| 6,668,742 | B2 | 12/2003 | Nadeau et al. | |
| 6,895,880 | B2 * | 5/2005 | Nakajima | B63B 34/10 114/55.53 |
| 7,380,512 | B2 * | 6/2008 | Curtin | B63B 34/10 114/55.53 |
| 10,011,327 | B2 * | 7/2018 | Sato | B63B 34/10 |
| 10,336,409 | B1 * | 7/2019 | Girard | B63B 34/10 |
| 2008/0041287 | A1 * | 2/2008 | Toupin | B63B 19/00 114/55.53 |
| 2019/0176924 | A1 * | 6/2019 | Iwata | B62J 43/28 |
| 2022/0194526 | A1 * | 6/2022 | Araki | B63H 25/02 |

* cited by examiner

*Primary Examiner* — S. Joseph Morano
*Assistant Examiner* — Jovon E Hayes
(74) *Attorney, Agent, or Firm* — Alleman Hall Creasman & Tuttle LLP

(57) ABSTRACT

A personal watercraft includes a watercraft body including a deck. The deck includes a side-opening storage recessed inward to accommodate items. The side-opening storage has an opening facing outward in a width direction of the watercraft body.

19 Claims, 7 Drawing Sheets

PERSONAL WATERCRAFT

BACKGROUND OF THE INVENTION

Technical Field

The present disclosure relates to a personal watercraft.

Description of the Related Art

A personal watercraft includes an upwardly opening storage formed in the body of the watercraft. Such a personal watercraft is disclosed in U.S. Pat. No. 6,668,742. In the personal watercraft of U.S. Pat. No. 6,668,742, a storage is formed in a region anterior to a handle and located at the center of this region in the width direction of the body of the watercraft.

SUMMARY OF THE INVENTION

A personal watercraft according to an aspect of the present disclosure includes: a watercraft body including a hull and a deck covering an upper portion of the hull; a handle for steering maneuver; and a steering shaft extending from the handle to the watercraft body, the steering shaft being pivotable relative to the watercraft body in response to the steering maneuver performed using the handle, wherein the deck includes a side-opening storage recessed inward to accommodate items, the side-opening storage having at least one opening facing outward in a width direction of the watercraft body.

The above and further objects, features and advantages of the present disclosure will be more apparent from the following detailed description of preferred embodiments with reference to the accompanying drawings.

DETAILED DESCRIPTION OF THE EMBODIMENTS

Hereinafter, exemplary embodiments will be described with reference to the drawings. The up-down, left-right, and front-rear directions are defined herein as those based on the viewpoint of a rider (operator) of a personal watercraft who sits on a seat of the watercraft. The left-right direction and the front-rear direction are defined with respect to a horizontal plane in which the personal watercraft is located when moored at rest on water.

Figure 1:
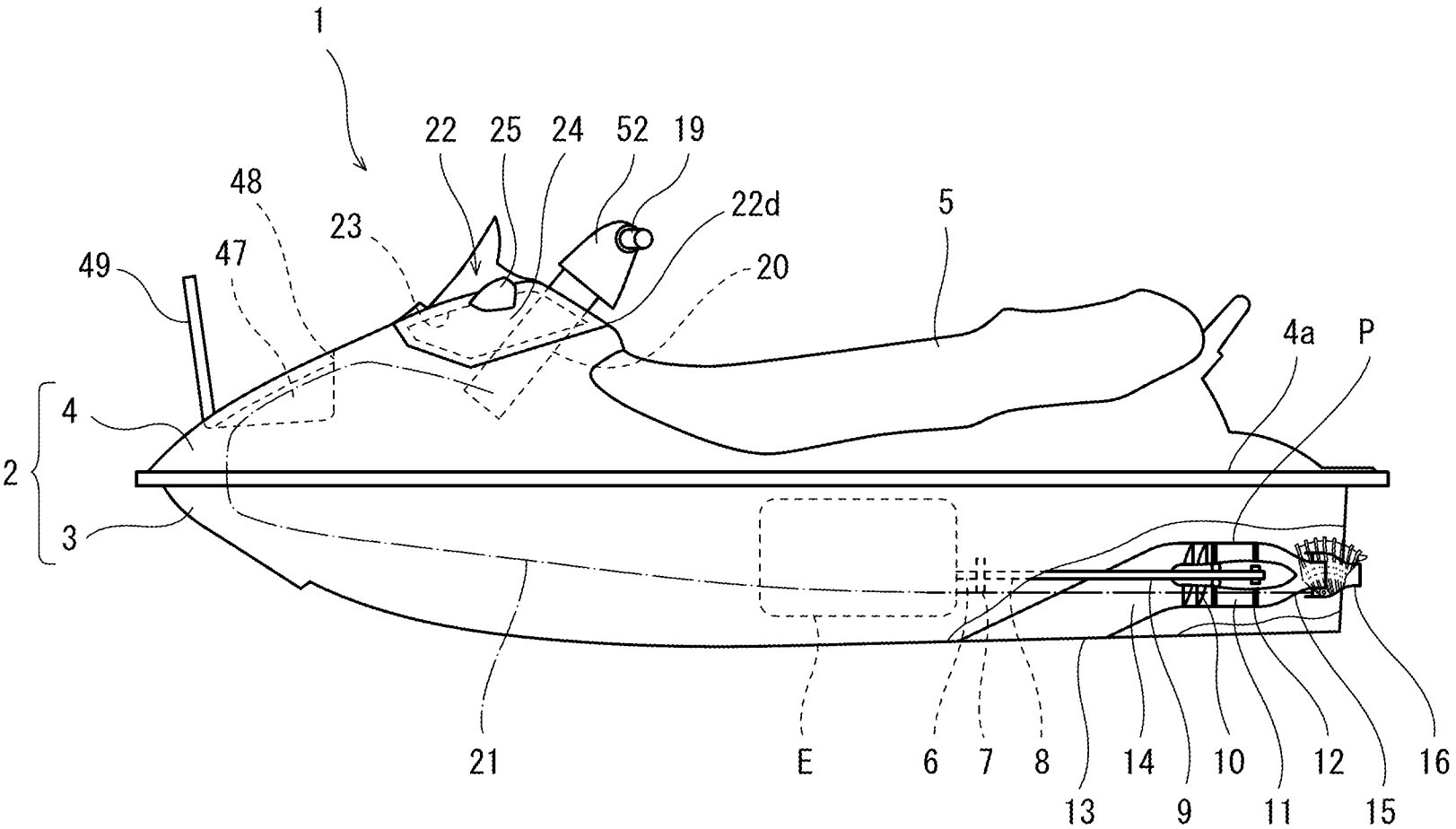
FIG. 1 is a side view of a personal watercraft according to an exemplary embodiment.

FIG. 1 is a partially cutaway side view of a personal watercraft 1 according to an exemplary embodiment. The personal watercraft 1 is operated by a rider gripping a handle bar and ejects water rearward through a water jet pump driven by a prime mover mounted on a watercraft body. Referring to FIG. 1, the personal watercraft 1 includes a watercraft body 2, and the watercraft body 2 includes a hull 3 and a deck 4 covering the upper portion of the hull 3. The personal watercraft 1 is a sitting-type watercraft having the watercraft body 2 equipped with a seat 5 on which the rider and another user sit in a straddling position. The watercraft body 2 includes an internal space, in which an engine E is accommodated as the prime mover.

The engine E includes an output shaft 6 extending toward the rear of the watercraft body 2. The output shaft 6 has an output end connected to a propeller shaft 8 via a coupler 7. A water jet pump P is disposed in the rear of the hull 3 and located at the center in the left-right direction. The water jet pump P includes a pump shaft 9, to which the propeller shaft 8 is connected. Thus, the pump shaft 9 rotates in conjunction with rotation of the output shaft 6. An impeller 10 is mounted on the pump shaft 9, and a stator vane 11 is disposed behind the impeller 10. A tubular pump casing 12 is mounted around the impeller 10 to enclose the impeller 10.

A water inlet 13 opens at the bottom of the watercraft body 2. The water inlet 13 is in communication with the pump casing 12 through a water passage 14. To the pump casing 12 is connected a pump nozzle 15 disposed in the rear of the watercraft body 2. The pump nozzle 15 has a diameter that decreases from front to rear, and an ejection orifice opens at the rear end of the pump nozzle 15. To the election orifice of the pump nozzle 15 is connected a steering nozzle 16, which is swingable to the left and right.

In the personal watercraft 1, water drawn into the hull 3 through the water inlet 13 located at the bottom of the hull 3 is pressurized and accelerated by rotational power of the impeller 10 of the water jet pump P driven by the engine E. The flow of water is adjusted by the stator vane 11 and ejected vigorously rearward through the ejection orifice of the pump nozzle 15 and the steering nozzle 16. Thus, the personal watercraft 1 obtains propulsion power using a reaction force produced by water ejected from the water jet pump P to the outside through the steering nozzle 16.

A handle 19 for steering maneuver is disposed on a front portion of the deck 4. The handle 19 is gripped by the rider. The handle 19 is fixedly connected to the steering shaft 20. The steering shaft 20 is pivotally supported by the watercraft body 2 with the aid of a bearing (not illustrated). Thus, the steering shaft 20 provides a connection between the handle 19 and the watercraft body 2. The steering shaft 20 extends downward from the handle 19. In the present embodiment, the steering shaft 20 is inclined with respect to the watercraft body 2 in such a manner that the upper end of the steering shaft 20 is posterior to the lower end of the steering shaft 20.

A steering cable 21 is attached to the vicinity of the lower end of the steering shaft 20. Thus, the handle 19 is connected to the steering nozzle 16 via the steering shaft 20 and the steering cable 21. The steering nozzle 16 swings to the left and right in conjunction with tilting movement of the handle 19 to the left and right.

The handle 19 is equipped with an accelerator (not illustrated). The rider can accelerate or decelerate the watercraft to a desired degree by operating the accelerator. By operating the handle 19, the rider can choose the direction in which the watercraft body 2 moves. Thus, the rider can maneuver the watercraft body 2 by operating the handle 19 and the accelerator.

The deck 4 includes a side-opening storage 22. The side-opening storage 22 of the deck 4 is provided as a storage space. Various items can be placed in the side-opening storage 22. The presence of the side-opening storage 22 improves the user-friendliness of the personal watercraft 1. The side-opening storage 22 is located around the steering shaft 20 in the deck 4. The side-opening storage 22 has openings 23 facing outward in the width direction of the watercraft body 2. In the present embodiment, the side-opening storage 22 of the deck 4 is provided as an inwardly recessed storage space, and the openings 23 are located at the opposite outer sides of the side-opening storage 22 in the width direction.

The deck 4 further includes an upper-opening storage 47 anterior to the side-opening storage 22. The upper-opening storage 47 is an inwardly recessed portion of the deck 4. A hatch cover 49 is configured to cover and uncover the upper-opening storage 47. The upper-opening storage 47 is provided as a storage space in which various items can be placed, and this storage space has an opening 48 facing upward.

The hatch cover 49 is disposed above the upper-opening storage 47 to cover the opening 48 of the upper-opening storage 47. The opening 48 of the upper-opening storage 47 extends obliquely rearward and upward, so that the height at which the opening 48 is located increases from front to rear. The hatch cover 49 is pivotally connected at its edge portion to the deck 4 by a hinge, the edge portion being anterior to and below the opening 48 of the upper-opening storage 47. When opened, the hatch cover 49 pivots about the connected edge portion anterior to and below the opening 48 of the upper-opening storage 47, and another edge portion of the hatch cover 49 that is opposite to the connected edge portion in the front-rear direction moves upward. When closed, the hatch cover 49 pivots about the connected edge portion relative to the upper opening storage 47 in a direction opposite to that in which the hatch cover 49 pivots when opened; namely, the other edge portion opposite to the connected edge portion in the front-rear direction moves downward toward the opening 48.

Since the side-opening storage 22 is provided in the deck 4 as a storage space which opens in the horizontal direction of the watercraft body, the rider or any other user on board can use the side-opening storage 22 for storage of items. Additionally, for example, when the personal watercraft 1 is positioned alongside the land, a person on the land can easily transfer items to and from the side-opening storage 22 without having to get on the personal watercraft 1. Thus, the presence of the side-opening storage 22 improves the user-friendliness of the personal watercraft 1 for not only the users on board the personal watercraft 1 but also the person who is not on board but in the vicinity of the personal watercraft 1. The deck 4 further includes the upper-opening storage 47 in addition to the side-opening storage 22; that is, the deck 4 includes a plurality of storage portions in each of which items can be placed. The inclusion of the plurality of storage portions allows for storage of a large amount of items, thus further improving the user-friendliness of the personal watercraft 1 for various users including the rider, the other user on board the personal watercraft 1, and the person in the vicinity of the personal watercraft 1.

In the present embodiment, the deck 4 is configured to extend in the front-rear direction of the watercraft body 2 in such a manner that the height of the deck 4 increases rearward from its front end to a point immediately anterior to the steering shaft 20. Thus, the highest point of the deck 4 is immediately anterior to the steering shaft 20. The side-opening storage 22 is configured to include the region of the deck 4 that is located around the highest point.

Lids 24 are disposed outward of the side-opening storage 22 in the width direction of the watercraft body 2 to cover the openings 23 of the side-opening storage 22. The lids 24 include a left lid 24*a* configured to cover a left opening 23*a* of a left space 22*a* and a right lid 24*b* configured to cover a right opening 23*b* of a right space 22*b*. Each of the left and right lids 24*a* and 24*b* is configured to, when opened, pivot outward in the width direction relative to the deck 4 about a pivot axis L1 described in detail later. Each of the left and right lids 24*a* and 24*b* is configured to, when closed, pivot inward in the width direction relative to the deck 4 about the pivot axis L1. Each of the left and right lids 24*a* and 24*b* is configured such that the lid 24 fully opened does not project outward in the width direction from the watercraft body 2. A side mirror 25 is mounted on each lid 24.

Figure 2:
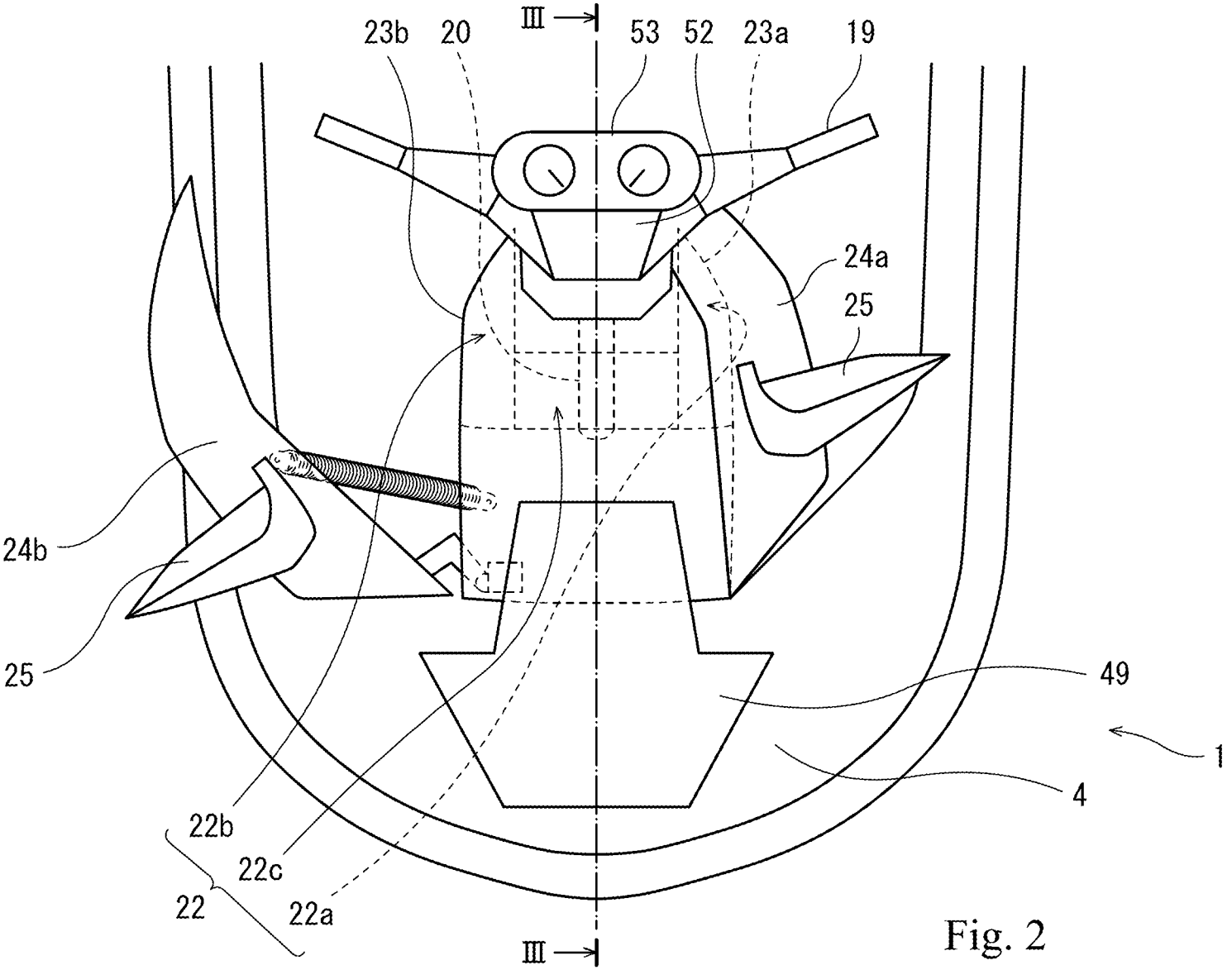
FIG. 2 is a plan view of a front portion of the personal watercraft of FIG. 1.
Figure 3:
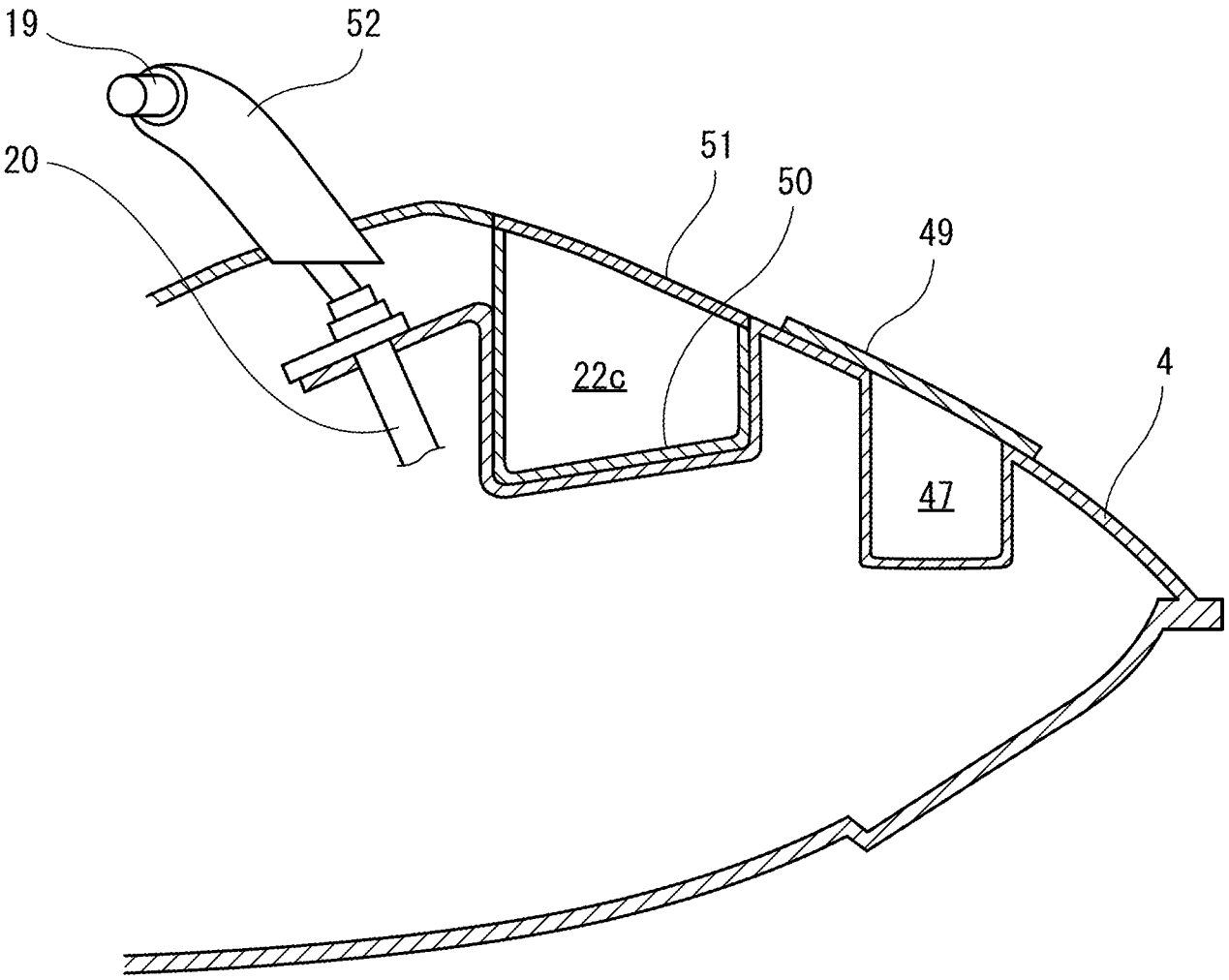
FIG. 3 is a cross-sectional view taken along the line of FIG. 2 and showing a side-opening storage and its vicinity in the personal watercraft of FIG. 1.
Figures 4A, 4B:
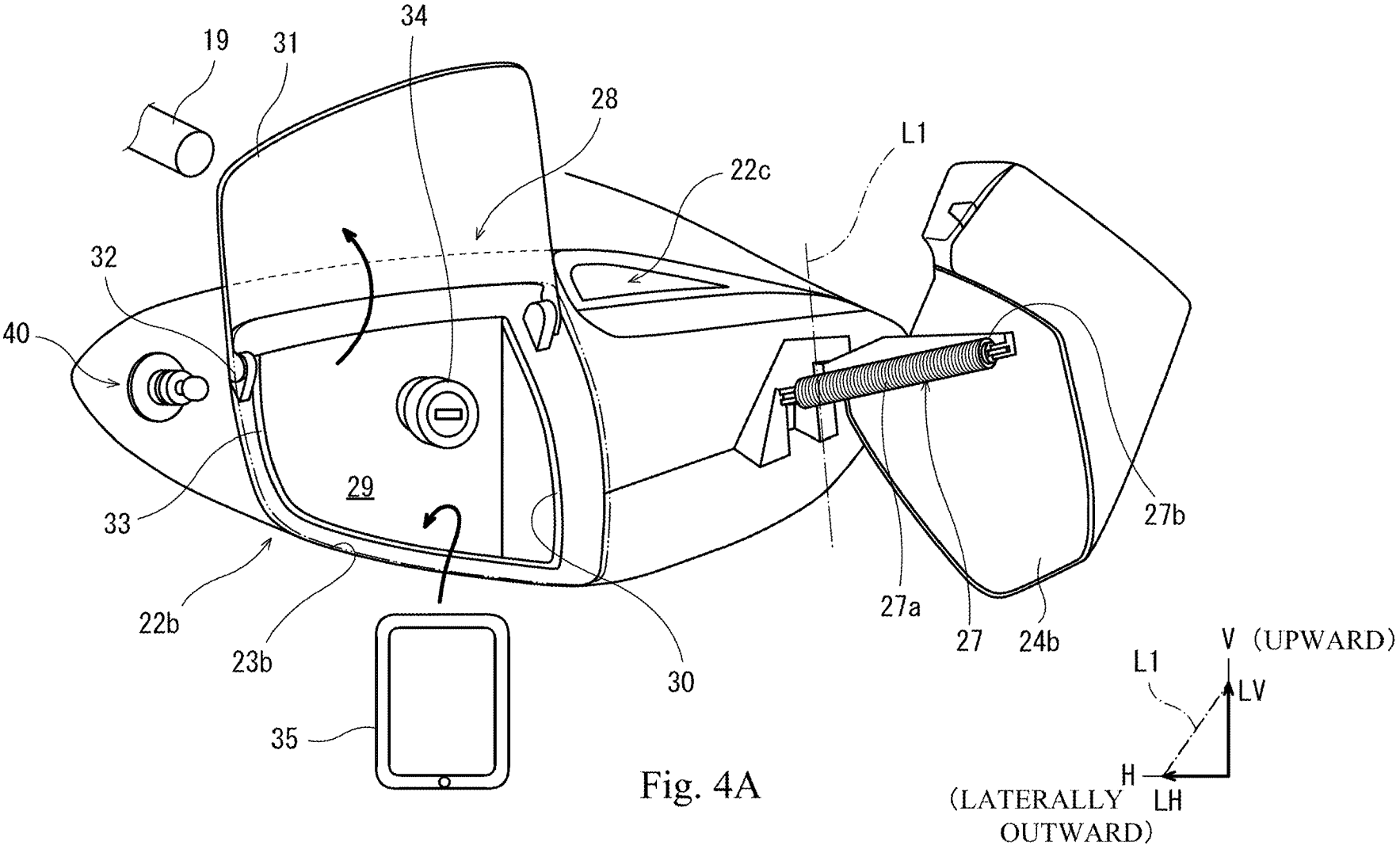
FIG. 4A is a perspective view showing a right opening of the side-opening storage and its vicinity in the personal watercraft of FIG. 1.
FIG. 4B illustrates a horizontal component and a vertical component of a direction of a pivot axis L1 shown in FIG. 4A.

FIG. 2 is a plan view of a front portion of the personal watercraft 1 in which the right lid 24*b* (one of the two lids 24 mounted respectively on the opposite outer sides of the deck 4 in the width direction) is open. FIG. 3 is a cross-sectional view of the personal watercraft 1 taken along a line dividing the personal watercraft 1 in two at its center in the width direction. FIG. 4A is a perspective view of the personal watercraft 1 for illustrating the right lid 24*b* (one of the two lids 24 mounted respectively on the opposite outer sides of the deck 4 in the width direction). FIG. 4B illustrates horizontal and vertical components of the direction of the pivot axis L1 of FIG. 4A about which the right lid 24*b* pivots.

Referring to FIG. 2, the side-opening storage 22 serving as a storage space includes the left space 22*a* having the left opening 23*a* facing leftward in the width direction, the right space 22*b* having the right opening 23*b* facing rightward in the width direction, and a central space 22*c* located at the center of the side-opening storage 22 in the width direction. In the present embodiment, a handle post 52, which will be described in detail later, is interposed between the left and right spaces 22*a* and 22*b*. The space of the side-opening storage 22 that is to the left of the handle post 52 is defined as the left space 22*a*. The left space 22*a* should be understood as including not only a region adjacent to the handle post 52 but also a region located to the left of the handle post 52 and extending in the front-rear direction from the region adjacent to the handle post 52. The space of the side-opening storage 22 that is to the right of the handle post 52 is defined as the right space 22*b*. The right space 22*b* should be understood as including not only a region adjacent to the handle post 52 but also a region located to the right of the handle post 52 and extending in the front-rear direction from the region adjacent to the handle post 52. The space of the side-opening storage 22 that is at substantially the same location as the handle post 52 in the front-rear direction is defined as the central space 22*c*. The central space 22*c* is configured to provide a connection between the left and right spaces 22*a* and 22*b* in the left-right direction. The left space 22*a* is configured such that the length of the left space 22*a* in the width direction decreases from front to rear in the region adjacent to the handle post 52 in the front-rear direction. The right space 22*b* is configured such that the length of the right space 22*b* in the width direction decreases from front to rear in the region adjacent to the handle post 52 in the front-rear direction. The two openings 23 of the side-opening storage 22 serving as a storage space are located respectively at the opposite outer sides of the watercraft body 2 in the width direction. In the present embodiment, the left and right openings 23*a* and 23*b* are formed as elongated holes extending longitudinally in the front-rear direction. Each opening 23 is spaced from and to the left or right of the center of the watercraft body 2 in the width direction.

In the side-opening storage 22, the left and right spaces 22*a* and 22*b* are in communication with each other via the central space 22*c* located at the center in the width direction. That is, the side-opening storage 22 is configured to allow the two openings 23*a* and 23*b*, which are located at the opposite outer sides of the watercraft body in the width direction, to communicate with each other via the central space 22*c*. The side-opening storage 22 is formed in a U-shape surrounding the steering shaft 20 on the front and opposite lateral sides. In the present embodiment, the central space 22*c* is the largest space among the left space 22*a*, right space 22*b*, and central space 22*c*.

Referring to FIG. 3, the deck 4 extends rearward from the front end of the personal watercraft 1 toward the steering shaft 20. In the upper-opening storage 47, a part of the deck 4 forms the bottom surface of the storage space. The hatch cover 49 is configured to cover and uncover the upper-opening storage 47 which is a recess provided as a storage space in the deck 4. The side-opening storage 22 is located posterior to the upper-opening storage 47.

The side-opening storage 22 is defined by a recess formed in the deck 4. Inside the recess formed in the deck 4 there are disposed a lower case 50 and an upper case 51. The lower case 50 is below the upper case 51 and convex downward. The upper case 51, which is above the lower case 50, is situated on an extension of the surface of the deck 4 that is anterior to the side-opening storage 22. The lower and upper cases 50 and 51 define a part of the storage spaces of the side-opening storage 22 provided in the deck 4. The lower and upper cases 50 and 51 are connected to each other, and the central space 22*c* of the side-opening storage 22 lies between the cases 50 and 51. Although FIG. 3 shows the central space 22*c* lying between the lower and upper cases 50 and 51, a part of the left space 22*a* or a part of the right space 22*b* may lie between the lower and upper cases 50 and 51 at a different location in the left-right direction than the central space 22*c*.

The bottom surface of the central space 22*c* is formed by the lower case 50. In the present embodiment, the bottom surface of the central space 22*c* is inclined downward from front to rear. The bottom surface of the central space 22*c* is at a lower height than the openings 23*a* and 23*b* of the left and right spaces 22*a* and 23*b*. Each of the left, right, and central spaces 22*a*, 22*b*, and 22*c* is provided with a hole through which water having entered the space is led out of the space. For example, when wet clothes or any other wet items are placed in the side-opening storage 22 and therefore water is retained in the side-opening storage 22, the water can be discharged out of the storage 22 through the holes.

FIG. 2 shows the personal watercraft 1 with the right lid 24*b* open and the left lid 24*a* closed. In the present embodiment, the side mirrors 25 are disposed on both the left and right side surfaces of the deck 4 of the personal watercraft 1. In particular, in the present embodiment, the side mirrors 25 are mounted on the left and right lids 24*a* and 24*b*. The side mirror 25 may be disposed on either of the left and right side surfaces of the deck 4. In this case, the side mirror 25 may be mounted on either of the left and right lids 24*a* and 24*b*. The side mirrors 25 need not be mounted on the personal watercraft 1. In the present embodiment, with the left lid 24*a* closed, a part of the left opening 23*a* of the side-opening storage 22 is posterior to the side mirror 25.

The side-opening storage 22 extends in the front-rear direction in such a manner as to overlap the steering shaft 20 in a side view of the personal watercraft 1. In both the left and right spaces 22*a* and 22*b* of the side-opening storage 22, the rear end 22*d* (FIG. 1) of the side-opening storage 22 is posterior to a part of the steering shaft 20 that is at the same height as the rear end 22*d*. That is, a part of each of the left and right openings 23*a* and 23*b* of the side-opening storage 22 is located in a region posterior to a rear end of a part of the steering shaft 20 that is at the same height of the part of the opening 23*a* or 23*b*. In the present embodiment, the rear ends of the left and right openings 23*a* and 23*b* as seen in a side view are adjacent to the handle post 52 in the front-rear direction of the watercraft body 2. In the present embodiment, the grip portion held by the rider operating the personal watercraft 1 is the handle 19. The shaft which rotates in conjunction with the handle 19 rotated by the rider to steer the personal watercraft 1 is the steering shaft 20. The component which supports the handle 19 and through which the rotation of the handle 19 for steering maneuver is transmitted to the steering shaft 20 is the handle post 52. In the present embodiment, a meter 53 for informing the rider of the watercraft speed and the engine speed is disposed above the handle post 52. The left and right openings 23*a* and 23*b* of the side-opening storage 22 are adjacent to the meter 53 in the left-right direction of the watercraft body 2. The front ends of the left and right openings 23*a* and 23*b* are adjacent to the front end of a region of the hull 3 in the front-rear direction of the watercraft body 2. The region of the hull 3 is that which extends parallel to the front-rear direction.

In a plan view of the watercraft body 2, the steering shaft 20 is interposed between opposite outer side portions of the side-opening storage 22 in the width direction. A part of the side-opening storage 22 is anterior to the steering shaft 20. That is, the side-opening storage 22 lies on the front and opposite lateral sides of the steering shaft 20, and the steering shaft 20 is surrounded by the side-opening storage 22 on the three sides, in particular the front and opposite lateral sides. As seen from the plan view of FIG. 2, when the watercraft body 2 is viewed in plan, the deck 4 includes the side-opening storage 22 disposed around the steering shaft 20, the side-opening storage 22 including a front portion anterior to the steering shaft 20 and opposite outer side portions outward of the steering shaft 20 in the width direction.

In the present embodiment, the side-opening storage 22 is disposed around the steering shaft 20 and serves as a storage space in which various items can be placed. A part of the side-opening storage 22 is located between the steering shaft 20 and the upper-opening storage 47 in the front-rear direction. A part of the side-opening storage 22 is located at a greater height than the upper-opening storage 47 in the up-down direction. A part of the side-opening storage 22 is located between the seat 5 and the handle 19 in the up-down direction. In this manner, the space lying around the steering shaft 20 is effectively used. Thus, the volume of the storage space for item storage can be increased to allow for storage of a larger amount of items. Additionally, the use of the space lying around the steering shaft 20 for formation of the storage space eliminates the need to lengthen the personal watercraft 1 in the width direction and front-rear direction to ensure a sufficiently wide space. This can prevent the personal watercraft 1 from increasing in size due to the formation of the storage space.

As shown in FIG. 4A, the lid 24 is pivotable about the pivot axis L1 relative to the deck 4 to cover and uncover the opening 23 of the side-opening storage 22. In the present embodiment, as seen from FIG. 4A, the pivot axis L1 is located at the front end of the lid 24 in the front-rear direction. In the example of FIG. 4A, the right lid 24*b* pivots about the pivot axis L1 relative to the deck 4 to cover and uncover the right opening 23*b* of the right space 22*b*. In the present embodiment, the left and right lids 24*a* and 24*b* are mounted on the deck 4 in the same manner and have the same configuration. The pivot axis L1 extends obliquely downward from inside to outside in the left-right direction of the watercraft body 2. That is, the pivot axis L1 extends in a direction having both a vertical component and a horizontal component. FIG. 4B shows the vertical component LV and horizontal component LH of the direction of the pivot axis L1. In FIG. 4B, the vertical direction of the pivot axis L1 is shown as a V axis and the horizontal direction of the pivot axis L1 is shown as an H axis. FIG. 4B is a side view showing the pivot axis L1 as viewed from the front of the watercraft body 2. In the present embodiment, the horizontal component LH of the direction of the pivot axis L1 corresponds to the left-right direction of the watercraft body 2. In FIGS. 4A to 7B, the side mirror 25 mounted on the lid 24 is omitted for convenience of illustration.

Since the pivot axis L1 of the lid 24 extends in a direction having a vertical component, the rear end of the lid 24 pivots in the width direction of the watercraft body 2 during the opening or closing movement. Since the direction in which the pivot axis L1 of the lid 24 extends further has a horizontal component (corresponding to the left-right direction of the watercraft body 2 in the present embodiment), the rear end of the lid 24 pivots also in the up-down direction of the watercraft body 2 during the opening or closing movement. In the present embodiment, the amount of the opening and closing movement of the lid 24 is greater in the left-right direction than in the up-down direction.

The lid 24 is connected to a support post 26 disposed on the deck 4 and is configured to pivot about the pivot axis L1 relative to the support post 26. A biasing structure 27 is disposed at a location between the support post 26 and the lid 24 (the right lid 24*b* in FIG. 4) and biases the lid 24 at the location between the support post 26 and the lid 24. The lid 24 is biased by the biasing structure 27 in a direction in which the lid 24 opens (opening direction). In the present embodiment, the biasing structure 27 includes a spring 27*a* and a damper element 27*b* to allow the lid 24 to smoothly move toward an open position. In the present embodiment, the spring 27*a* is located between the support post 26 and the lid 24, and the damper element 27*b* is radially inside the spring 27*a*. The biasing structure 27 may consist of the spring 27*a* without including the damper element 27*b*. In the present embodiment, in the watercraft body 2 with the lid 24 closed, a space accommodating the spring 27*a* and the damper element 27*b* is formed inward of the lid 24 in the left-right direction of the watercraft body 2. The lid 24 is bent in the vicinity of its center in the front-rear and up-down directions to protrude outward in the left-right direction of the watercraft body 2, so that the space inward of the lid 24 is created. The spring 27*a* and the damper element 27*b* are accommodated in the space formed inward of the lid 24 by the bending of the lid 24.

The support post 26 is provided with a stopper (not illustrated) for holding the lid 24 open. When opened to a certain extent, the lid 24 is biased by the biasing structure 27 to a position (predetermined position) where the opening movement of the lid 24 is blocked by the stopper. Thus, once opened, the lid 24 is biased by the biasing structure 27 so that the lid 24 is held open. In the present embodiment, the position where the movement of the lid 24 is blocked by the stopper is defined such that the lid 24 opened to a sufficient extent does not protrude out of the watercraft body 2 in the left-right direction. When the lid 24 is opened, the stopper restricts the amount of the pivoting movement of the lid 24 to prevent the lid 24 from pivoting in the opening direction beyond a predetermined extent.

As described above, the biasing structure 27 biases the lid 24 to induce the opening movement of the lid 24 and hold the lid 24 open. In the present embodiment, during the opening movement of the lid 24, the damper element 27*b* of the biasing structure 27 allows the lid 24 to move at a constant speed lower than a speed at which the lid 24 would open if the lid 24 was merely biased by the spring 27*a*. In the present embodiment, the position of the opened lid 24 (predetermined position) is where the entire lid 24 is inward of the outer end of the deck 4 in the width direction of the watercraft body 2.

A pocket 28 is disposed inside the right space 22*b* of the side-opening storage 22. In the present embodiment, no pocket is disposed inside the left space 22*a*. The pocket 28 is disposed inside the right space 22*b* in a manner as shown in FIG. 4A. Specifically, the pocket 28 having a smaller volume than the side-opening storage 22 is placed entirely within the right space 22*b* and is at a rear location inside the right space 22*b*. While in the present embodiment the pocket 28 is disposed only inside the right space 22*b*, the location of the pocket 28 is not limited to that in this embodiment. That is, the location of the pocket 28 is not limited to the right side of the side-opening storage 22, and the pocket 28 may be disposed in the left space 22*a* of the side-opening storage 22. The pocket 28 may be disposed in each of the left and right spaces 22*a* and 22*b*.

The pocket 28 includes a pocket recess 29 located inside the right space 22*b* of the side-opening storage 22 of the deck 4 and extending downward and inward in the width direction. The pocket recess 29 has a pocket opening 30 facing outward in the width direction. The pocket 28 includes a pocket lid 31 configured to cover the pocket opening 30 from outside in the width direction.

In the present embodiment, the pocket lid 31 is connected to the deck 4 by a hinge 32 and pivotable relative to the pocket opening 30 of the pocket recess 29. The hinge 32 is located above the pocket opening 30. When moving in such a direction as to uncover the pocket opening 30, the pocket lid 31 pivots upward about the pivot axis of the hinge 32. When moving in such a direction as to cover the pocket opening 30, the pocket lid 31 pivots downward about the pivot axis of the hinge 32. In the present embodiment, the right lid 24*b* cannot be closed unless the pocket lid 31 is fully closed.

Either the pocket recess 29 or the pocket lid 31 is equipped with a seal 33 to provide sealing between the periphery of the pocket opening 30 and the pocket lid 31. In the present embodiment, a rubber material is used as the seal 33. In the present embodiment, the seal 33 is disposed along the periphery of the pocket opening 30 of the pocket recess 29. The seal 33 may be disposed along the outer periphery of the pocket lid 31. In the present embodiment, thanks to the seal 33 disposed to provide sealing between the periphery of the pocket opening 30 and the pocket lid 31, the pocket 28 with the pocket lid 31 closed is watertight to prevent water from entering the pocket recess 29.

With the pocket lid 31 closed, the pocket lid 31 covers the pocket opening 30 and is in contact with the seal 33. In this situation, the seal 33 is elastically deformed to seal the gap between the pocket lid 31 and the pocket opening 30. Thus, with the pocket lid 31 closed, the seal 33 prevents entry of water into the pocket recess 29 and ensures the watertightness of the pocket 28. The "fully closed" state of the pocket lid 31 refers to a state in which the pocket lid 31 covers the pocket opening 30 and closes the pocket recess 29 and in which the pocket lid 31 is in contact with the seal 33 and ensures the watertightness of the pocket 28.

In the present embodiment, the pocket lid 31 is made of a light-transmissive material (such as a transparent resin). Thus, with the pocket lid 31 closed, the interior of the pocket recess 29 can be visually checked. As such, the rider can check whether any item is placed in the pocket 28 and what kind of item is placed in the pocket 28 without having to open the pocket lid 31. This renders the pocket 28 more user-friendly for the rider.

In the present embodiment, an electric power supply connector 34 is disposed on one side surface of the pocket recess 29. The one side surface is innermost in the width direction of the watercraft body 2 among the side surfaces of the pocket recess 29, and the electric power supply connector 34 projects outward in the width direction from the one side surface. The electric power supply connector 34 is connectable to an electronic device such as a mobile terminal.

FIG. 4A illustrates placement of a mobile terminal 35 into the pocket 28. With the mobile terminal 35 connected to the electric power supply connector 34 by means such as a charging cable, electric power can be supplied to the mobile terminal 35 through the electric power supply connector 34. The pocket 28, which is disposed inside the side-opening storage 22, is closer to the seat 5 (FIG. 1) on which the rider sits than the center of the side-opening storage 22 in the front-rear direction of the watercraft body 2. Thus, the pocket 28 is closer to the right opening 23*b* of the right space 22*b* of the side-opening storage 22 than the center of the watercraft body 2 in the width direction of the watercraft body 2.

Figure 5A:
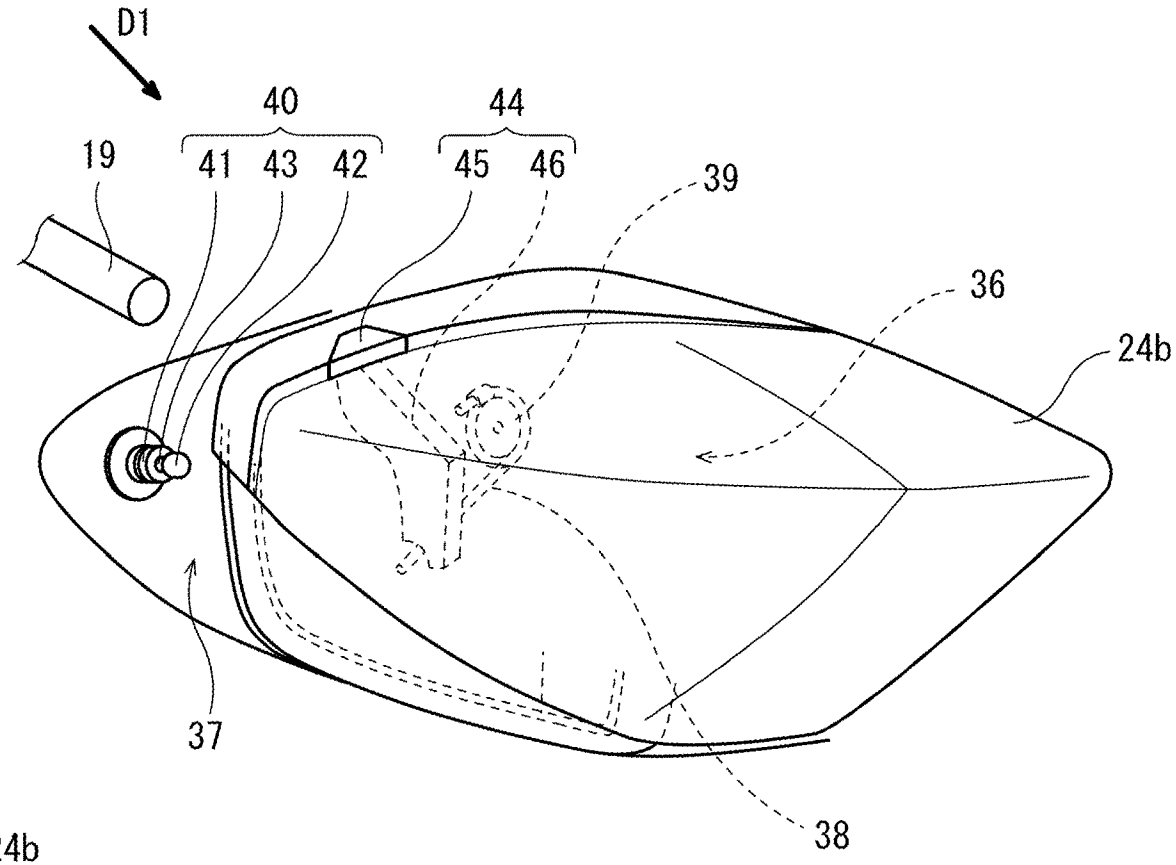
FIG. 5A is a perspective view showing a lock included in a lid of the side-opening storage of FIG. 4A and a retainer included in the deck.
Figure 5B:
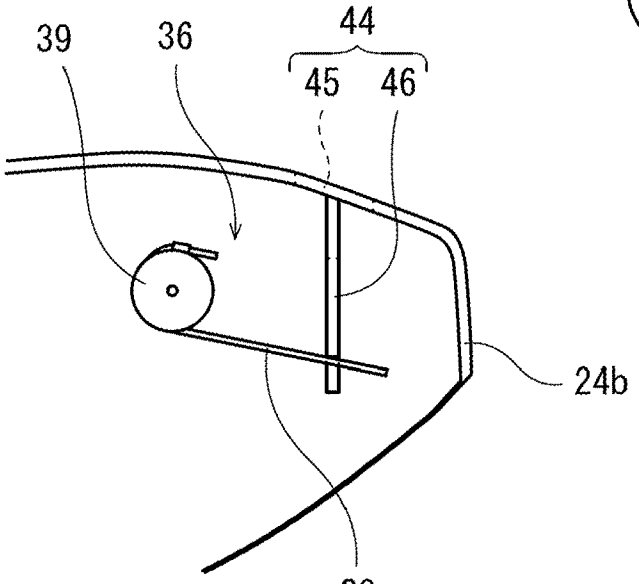
FIG. 5B is a plan view showing the inside of the lid of FIG. 5A as viewed in the direction of the arrow D1.

The following describes engagement and disengagement effected between the lid 24 and the deck 4 at the side-opening storage 22. FIG. 5A is a perspective view showing a region where the right lid 24*b* and the deck 4 are engaged and disengaged at the right space 22*b* of the side-opening storage 22. The surface of the right lid 24*b* shown in FIG. 5A is defined herein as an outer surface of the right lid 24*b*. FIG. 5B is a plan view showing a surface of the right lid 24*b* opposite the outer surface, and the opposite surface is defined as an inner surface of the right lid 24*b*. In the plan view of FIG. 5B, the right lid 24*b* is viewed in the direction of the arrow D1 of FIG. 5A. In the present embodiment, as shown in FIG. 5A, the right lid 24*b* is provided with a lock 36 for locking the right lid 24*a* to the deck 4, and the deck 4 is provided with a retainer 37 configured to retain the lock 36. In the present embodiment, the lock 36 is disposed on the inner surface of the right lid 24*b* (the surface of the closed right lid 24*b* that faces inward in the width direction). The retainer 37 for retaining the lock 36 of the right lid 24*b* is disposed on an inner side surface of the right space 22*b* of the deck 4.

While in the present embodiment the lid 24 is provided with the lock 36 and the deck 4 is provided with the retainer 37, the locations of the lock and retainer are not limited to those in this embodiment. The deck 4 may be provided with a lock, and the lid 24 may be provided with a retainer configured to retain the lock. It is sufficient that one of the lid 24 and the deck 4 be provided with a lock and the other of the lid 24 and the deck 4 be provided with a retainer configured to retain the lock.

The lock 36 includes a string-like element 38 made of metal. The string-like element 38 is elastic. The lock 36 further includes a disc-shaped flange 39. One end portion of the string-like element 38 is wound around and secured to the flange 39.

The retainer 37 includes a pin 40 disposed on one side surface of the right space 22*b* of the side-opening storage 22 of the deck 4. The one side surface is innermost in the width direction of the watercraft body 2 among the side surfaces of the right space 22*b*, and the pin 40 projects outward in the width direction of the watercraft body 2 from the one side surface. The pin 40 includes a main body 41 and a tip 42 directed outward in the width direction of the watercraft body 2. Between the main body 41 and the tip 42 there is disposed an insert receiver 43. The insert receiver 43 is in the form of a gap between the main body 41 and the tip 42.

A longitudinal part of the string-like element 38 of the lock 36 is inserted into the insert receiver 43 of the pin 40 of the retainer 37, and thus the string-like element 38 of the lock 36 and the pin 40 of the retainer 37 are engaged (the details of the engagement will be described later). Consequently, the closed right lid 24*b* is engaged with the deck 4.

Figure 6:
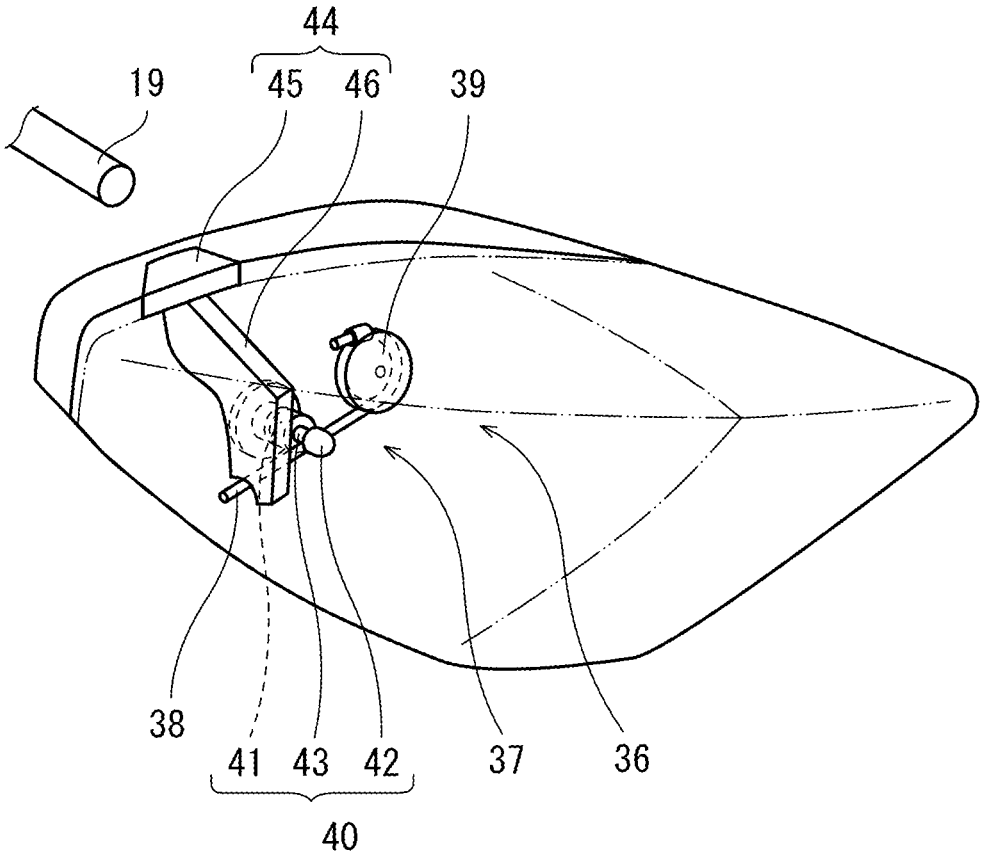
FIG. 6 is a perspective view showing the side-opening storage of FIG. 4A with the lock and the retainer in engagement.

FIG. 6 is a perspective view showing the right space 22*b* of the side-opening storage 22 with the lock 36 of the right lid 24*b* and the retainer 37 of the deck 4 engaged by insertion of a part of the string-like element 38 of the lock 36 into the insert receiver 43 of the pin 40 of the retainer 37. The engagement between the lock 36 and the retainer 37 holds the right lid 24*b* closed on the deck 4.

The right lid 24*b* includes a disengaging structure 44 configured to disengage the string-like element 38 of the lock 36 and the pin 40 of the retainer 37. As shown in FIG. 5A, the disengaging structure 44 includes an operation unit (button) 45 and a contactor 46 configured to contact the string-like element 38. The operation unit 45 is located on an upper portion of the right lid 24*b* and configured to be pressed downward. In the present embodiment, the location of the operation unit 45 in the front-rear direction of the watercraft body 2 corresponds to the location of the handle post 52 in the front-rear direction. Specifically, the operation unit 45 is located below the handle post 52. The operation unit 45 is anterior to the seat 5 (FIG. 1) in the front-rear direction of the watercraft body 2.

In the present embodiment, as shown in FIG. 6, the right lid 24*b* is located below the handle 19, and the operation unit 45 is located below and in proximity to the handle 19. The contactor 46 is connected to the operation unit 45. Thus, when the operation unit 45 is pressed downward, the contactor 46 also moves downward in conjunction with the movement of the operation unit 45.

Figure 7B:
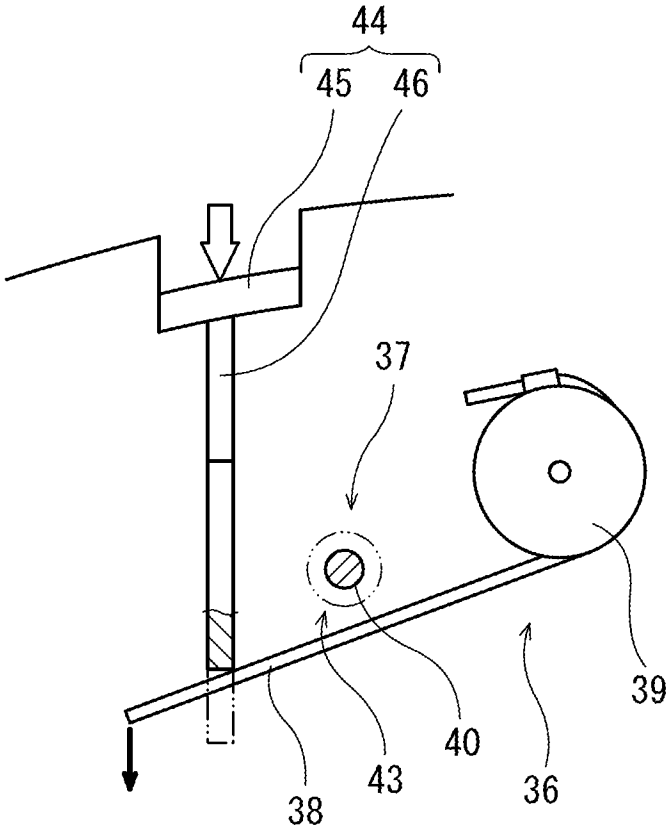
FIG. 7B illustrates the lock, the retainer, and the disengaging structure with the lock and the retainer disengaged by the disengaging structure.
Figure 7A:
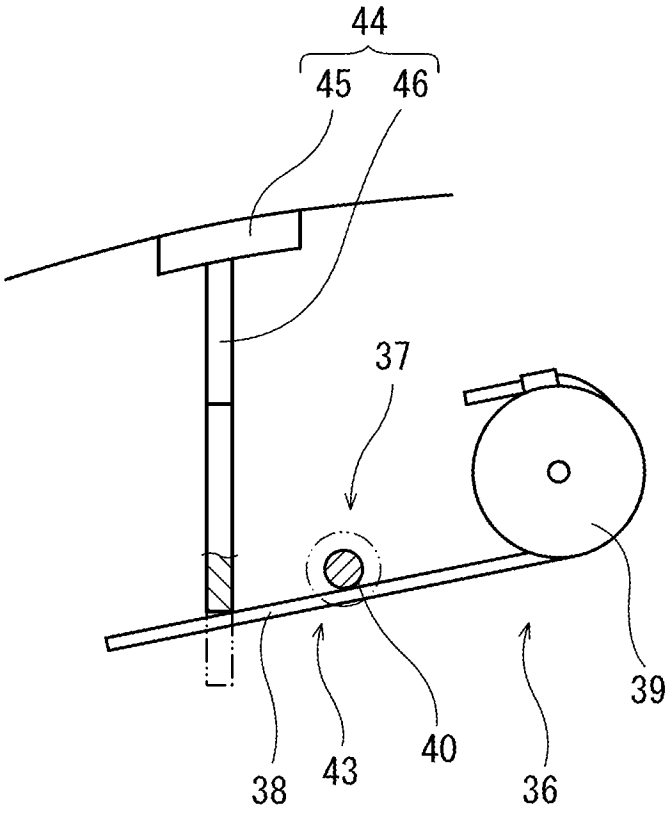
FIG. 7A illustrates the lock, the retainer, and a disengaging structure with the lock and the retainer in engagement as shown in FIG. 6.

The following describes how the lock 36 of the right lid 24*b*, the retainer 37 of the deck 4, and the disengaging structure 44 move during disengagement between the lock 36 and the retainer 37 with reference to FIGS. 7A and 7B. FIGS. 7A and 7B schematically illustrate the lock 36, retainer 37, and disengaging structure 44 in an enlarged manner. FIGS. 7A and 7B are each a partial cross-sectional view showing a region around the points of contact of the string-like element 38 of the lock 36 with the pin 40 of the retainer 37 and with the contactor 46 of the disengaging structure 44. FIG. 7A shows the lock 36, retainer 37, and disengaging structure 44, with the lock 36 and the retainer 37 in engagement in the space which is inward of the right lid 24*b* in the left-right direction. FIG. 7B shows the lock 36, retainer 37, and disengaging structure 44 at the moment when the lock 36 and the retainer 37 are disengaged.

As stated above and shown in FIG. 7A, when the lock 36 of the right lid 24*b* and the retainer 37 and the deck 4 are engaged, a part of the string-like element 38 is received into the insert receiver 43 of the pin 40 to provide the engagement between the lock 36 of the right lid 24*b* and the retainer 37 of the deck 4.

As shown in FIG. 7B, when the rider presses and moves the operation unit 45 downward, the contactor 46 moves downward to press the string-like element 38 in contact with the contactor 46, and thus the string-like element 38 is moved downward. The string-like element 38 is accordingly released from the insert receiver 43 of the pin 40. As a result, the lock 36 of the right lid 24*b* is released from the retainer 37 of the deck 4, so that the right lid 24*b* is disengaged from the deck 4. Once the right lid 24*b* is disengaged from the deck 4, the right lid 24*b* moves in the opening direction as illustrated in FIG. 4. In this case, the right lid 24*b* is moved by the biasing force of the biasing structure 27 to the position where the movement of the right lid 24*b* is blocked by the stopper. The right lid 24*b* becomes fully open at the position where the movement of the right lid 24*b* is blocked and ended by the stopper. The opening movement of the right lid 24*b* is accomplished in this manner. The opened right lid 24*b* is held open by the biasing force of the biasing structure 27. As described above, the operation unit 45 is operable to actuate the disengaging structure 44 and cause the disengaging structure 44 to release the string-like element 38 from the insert receiver 43 into which the string-like element 38 has been inserted. In the present embodiment, the handle 19 as viewed in plan with the left and right lids 24*a* and 24*b* closed is located above and overlaps both the left and right lids 24*a* and 24*b*. Specifically, with the lids 24*a* and 24*b* closed, the handle 19 is located above and overlaps the operation unit 45 of the disengaging structure 44.

The foregoing describes how the right side of the personal watercraft 1 is configured for the engagement between the lock 36 of the right lid 24*b* and the retainer 37 of the deck 4. The left side of the personal watercraft 1 is configured in the same manner for the engagement between the left lid 24*a* and the deck 4.

In the present embodiment, the openings 23 of the side-opening storage 22 face outward in the width direction of the watercraft body 2. This allows the rider to access the openings 23 from the side of the watercraft body 2 to transfer items to and from the side-opening storage 22. Thus, the rider can perform the item transfer at a lower level than if the storage had an opening facing relatively upward. This renders the personal watercraft 1 a convenient personal watercraft. Additionally, for example, when the personal watercraft 1 is positioned alongside the land, a person who is not on board but in the vicinity of the personal watercraft 1 can access the openings 23 from the side of the watercraft body 2 without having to get on the watercraft body 2 and easily place items into the side-opening storage 22. As such, the personal watercraft 1 is convenient also for the person who is in the vicinity of the personal watercraft 1.

In the present embodiment, the side-opening storage 22 having the openings 23 facing outward in the width direction of the watercraft body 2 is disposed around the steering shaft 20. This allows the rider to remain sitting on the seat 5 when accessing the side-opening storage 22 to transfer items to and from the side-opening storage 22. Thus, the rider does not have to get off the seat 5 once and sit again on the seat 5 when performing the item transfer to and from the side-opening storage 22. This also renders the personal watercraft 1 user-friendly for the rider.

In the present embodiment, when the lid 24 is opened to uncover the opening of the side-opening storage 22 or closed to cover the opening of the side-opening storage 22, the lid 24 moves in the width direction of the watercraft body 2 by pivoting about the pivot axis L1 extending in a direction having a vertical component. Thus, the amount of upward movement of the lid 24 can be reduced to prevent the lid 24 from interfering with neighboring components (such as the handle) located above the lid 24.

In the present embodiment, when the closed lid 24 is opened, the lid 24 moves by pivoting about the pivot axis L1 extending in a direction having a horizontal component. During the opening movement, the lid 24 can avoid the handle 19 and upwardly protruding portions of the deck 4 while moving in the up-down direction. Thus, interference of the moving lid 24 with other components neighboring the lid 24 can be prevented.

In the present embodiment, when the closed lid 24 is opened, the amount of the movement of the rear end of the lid 24 is greater in the width direction of the watercraft body 2 than in the up-down direction of the watercraft body 2.

Since the direction in which the lid 24 moves when opened and closed includes not only a component in the width direction of the watercraft body 2 but also a component in the up-down direction of the watercraft body 2, the personal watercraft 1 can easily be designed so as to avoid interference between the trajectory along which the lid 24 is opened and closed and other components of the watercraft body 2 which neighbor the lid 24.

In the present embodiment, the lid 24 is held closed by the engagement between the lock 36 and the retainer 37. Thus, the closing of the lid 24 can easily be accomplished by the engagement between the lock 36 and the retainer 37. This also renders the personal watercraft 1 user-friendly for the rider. Further, another user on board the personal watercraft 1 or a person who is not on board but in the vicinity of the personal watercraft 1 can also easily close the lid 24. Thus, the personal watercraft 1 is user-friendly also for the other user on board and the person who is in the vicinity of the personal watercraft 1.

In the present embodiment, the disengaging structure 44 is actuatable to disengage the lock 36 and the retainer 37, and the lid 24 is held open by being biased to the predetermined position by the biasing structure 27. Thus, the lid 24 can be opened and held open by operating the disengaging structure 44. This eliminates the need for the rider to pull and move the lid 24 when opening the lid 24. Additionally, the lid 24 can be held open without the rider having to keep holding the lid 24. These advantages also render the personal watercraft 1 user-friendly for the rider. Such a personal watercraft 1 is user-friendly also for another user on board the personal watercraft 1 or a person who is not on board but in the vicinity of the personal watercraft 1.

In the present embodiment, the opened lid 24 is biased to and heled in the position where the entire lid 24 is inward of the outer end of the deck 4 in the width direction of the watercraft body 2. Thus, for example, when the personal watercraft 1 is positioned alongside the shore and moored close to a high wall, contact of the lid 24 with the wall can be prevented.

In the present embodiment, the operation unit 45 is located below and in proximity to the handle 19. Thus, the rider sitting on the seat 5 can easily operate the operation unit 45 to open and close the lid 24. This also renders the personal watercraft 1 user-friendly.

In the present embodiment, the two openings 23 of the side-opening storage 22 are respectively located at the opposite outer sides of the watercraft body 2 in the width direction of the watercraft body 2. Thus, the rider can place items into the side-opening storage 22 from either side of the personal watercraft 1. This also renders the personal watercraft 1 convenient. Additionally, another user on board the personal watercraft 1 or a person who is not on board but in the vicinity of the personal watercraft 1 can also place items into the side-opening storage 22 from either side of the personal watercraft 1. The personal watercraft 1 is therefore convenient also for the other user on board and the person who is in the vicinity of the personal watercraft 1.

In the present embodiment, the side-opening storage 22 is configured to allow the two openings 23, which are located at the opposite outer sides of the watercraft body 2 in the width direction, to communicate with each other. Thus, the rider can access one and the same side-opening storage 22 through either of the left and right openings 23*a* and 23*b*. This also renders the personal watercraft 1 user-friendly for the rider. Additionally, another user on board the personal watercraft 1 or a person who is not on board but in the vicinity of the personal watercraft 1 can also access one and the same side-opening storage 22 through either of the left and right openings 23*a* and 23*b*. The personal watercraft 1 is therefore user-friendly also for the other user on board and the person who is in the vicinity of the personal watercraft 1.

In the present embodiment, the pocket 28 smaller than the side-opening storage 22 is disposed inside the side-opening storage 22, and a small item such as a mobile terminal can be placed in the pocket 28. Additionally, the seal 33 provides sealing between the periphery of the opening 30 of the pocket 28 and the lid 24 and ensures the watertightness of the pocket 28 to prevent entry of water into the pocket 28. The pocket 28 is therefore suitable for placement of items the water adhesion to which is undesired. This also renders the personal watercraft 1 user-friendly for the rider. Such a personal watercraft 1 is user-friendly also for another user on board the personal watercraft 1 or a person who is not on board but in the vicinity of the personal watercraft 1 when the other user on board or the person who is in the vicinity of the personal watercraft 1 places items into the pocket 28.

In the present embodiment, the pocket 28 is located in proximity to the opening 23 of the side-opening storage 22, and the opening 30 of the pocket 28 faces outward in the width direction of the watercraft body 2. Thus, the rider can easily access the pocket 28. Such a pocket 28 of the personal watercraft 1 is user-friendly for the rider.

In the present embodiment, the pocket 28 is located in proximity to the seat 5 in the front-rear direction of the watercraft body 2 and thus easily accessible by the rider. This also renders the personal watercraft 1 user-friendly for the rider.

In the present embodiment, the pocket 28 includes the electric power supply connector 34 located inside the pocket 28, and an electronic device placed in the pocket 28 can be supplied with electric power through the electric power supply connector 34. Thus, the rider can charge the electronic device while operating the personal watercraft 1. This also renders the personal watercraft 1 user-friendly for the rider. Such a personal watercraft 1 is user-friendly also for another user on board the personal watercraft 1 or a person who is not on board but in the vicinity of the personal watercraft 1 because an electronic device possessed by the other user on board or the person who is in the vicinity of the personal watercraft 1 can also be connected to the electric power supply connector 34 to charge the electronic device while the rider is operating the personal watercraft 1.

In the present embodiment, the side mirror 25 is mounted on the lid 24, and there is no need to dispose the side mirror 25 and the lid 24 at different locations on the deck 4. Thus, the available area of the deck 4 can be efficiently used. Additionally, since the area for mounting of the side mirror 25 is used also for the side-opening storage 22, the side-opening storage 22 is increased in size to accommodate a larger amount of items. This also renders the personal watercraft 1 user-friendly for the rider. Such a personal watercraft 1 is user-friendly also for another user on board the personal watercraft 1 or a person who is not on board but in the vicinity of the personal watercraft 1 when the other user on board or the person who is in the vicinity of the personal watercraft 1 places items into the side-opening storage 22.

In the present embodiment, a part of the opening 23 of the side-opening storage 22 extends to a point posterior to the side mirror 25, and thus the opening 23 is long in the front-rear direction. Further, the opening 23 of the side-opening storage 22 extends from a point anterior to the steering shaft 20 to a point posterior to the steering shaft 20. This also means that the opening 23 is long in the front-rear direction. Thus, the side-opening storage 22 can accommodate a large amount of items, and this also renders the personal watercraft 1 user-friendly for the rider. Such a personal watercraft 1 is user-friendly also for another user on board the personal watercraft 1 or a person who is not on board but in the vicinity of the personal watercraft 1 when the other user on board or the person who is in the vicinity of the personal watercraft 1 places items into the side-opening storage 22.

In the present embodiment, the deck 4 includes a storage (storage space) which is disposed around the steering shaft 20 in a plan view of the watercraft body 2, the storage including a front portion anterior to the steering shaft 20 and opposite outer side portions outward of the steering shaft 20 in the width direction. Thus, the space around the steering shaft 20 is effectively used for the storage. Such a storage can be increased in volume along with overall size reduction of the personal watercraft 1.

In the present embodiment, the pivot axis L1 about which the lid 24 pivots when opened and closed extends in a direction having both a vertical component and a horizontal component (V component LV and H component LH shown for the pivot axis L1 in FIG. 4B). Thus, the lid 24 moves in both the width and up-down directions of the watercraft body 2 when covering and uncovering the opening of the storage. The lid 24 can accomplish the covering and uncovering of the opening of the storage while avoiding neighboring components located above the lid 24 by moving in both the width and up-down directions of the watercraft body 2.

In the present embodiment, the opening 23 of the side-opening storage 22 is formed in a region posterior to the upper-opening storage 47. This means that the opening 23 of the side-opening storage 22 is long in the front-rear direction. Thus, the side-opening storage 22 can accommodate a large amount of items, and this also renders the personal watercraft 1 user-friendly for the rider. Such a personal watercraft 1 is user-friendly also for another user on board the personal watercraft 1 or a person who is not on board but in the vicinity of the personal watercraft 1 when the other user on board or the person who is in the vicinity of the personal watercraft 1 places items into the side-opening storage 22.

While in the embodiment described above the watercraft body 2 includes both the side-opening storage 22 and the upper-opening storage 47, the watercraft body 2 is not limited to that of the above embodiment. The watercraft body 2 need not include the upper-opening storage 47 and may include only the side-opening storage 22 as a storage space. While in the above embodiment the horizontal component of the direction of the pivot axis L1 of the lid 24 corresponds to the left-right direction of the watercraft body 2, the horizontal component of the direction of the pivot axis L1 is not limited to that of the above embodiment. The horizontal component of the direction of the pivot axis L1 may correspond to the front-rear direction of the watercraft body 2.

What is claimed is:

1. A personal watercraft comprising:

a watercraft body including a hull and a deck covering an upper portion of the hull;

a handle for steering maneuver;

a steering shaft extending from the handle to the watercraft body, the steering shaft being pivotable relative to the watercraft body in response to the steering maneuver performed using the handle; and a lid, wherein the deck includes a side-opening storage recessed inward to accommodate items, the side-opening storage having at least one opening facing outward in a width direction of the watercraft body, the lid is configured to cover the opening of the side-opening storage, the lid is pivotable about a pivot axis relative to the deck to cover and uncover the opening of the side-opening storage, and the pivot axis extends in a direction having a vertical component.

2. The personal watercraft according to claim 1, wherein the direction in which the pivot axis extends further has a horizontal component.

3. The personal watercraft according to claim 1, wherein one of the lid and the deck is provided with a lock, the other of the lid and the deck is provided with a retainer configured to retain the lock, and the lock and the retainer are engageable to hold the lid closed on the deck.

4. The personal watercraft according to claim 3, further comprising a biasing structure biasing the lid to a predetermined position, wherein the lid or the deck includes a disengaging structure configured to, when the lock and the retainer are in engagement and the lock is retained by the retainer, release the lock from the retainer and disengage the lock and the retainer, once the lock and the retainer are disengaged by the disengaging structure, the lid becomes movable to be opened, and the opened lid is held open by being biased to the predetermined position by the biasing structure.

5. The personal watercraft according to claim 4, wherein the predetermined position is where the entire lid is inward of an outer end of the deck in the width direction of the watercraft body.

6. The personal watercraft according to claim 4, further comprising an operation unit operable to actuate the disengaging structure and cause the disengaging structure to disengage the lock and the retainer, the operation unit being located below and in proximity to the handle.

7. The personal watercraft according to claim 1, wherein the at least one opening includes two openings located respectively at opposite outer sides of the watercraft body in the width direction of the watercraft body.

8. The personal watercraft according to claim 7, wherein the side-opening storage is configured to allow the two openings to communicate with each other.

9. The personal watercraft according to claim 1, further comprising:

a pocket smaller than the side-opening storage and disposed inside the side-opening storage;

a pocket lid configured to cover an opening of the pocket; and a seal configured to provide sealing between the pocket lid closed and a periphery of the opening of the pocket.

10. The personal watercraft according to claim 9, wherein the pocket is closer to the opening of the side-opening storage than a center of the watercraft body in the width direction of the watercraft body, and the opening of the pocket faces outward in the width direction of the watercraft body.

11. The personal watercraft according to claim 9, wherein the pocket is closer to a seat on which a rider sits than a center of the side-opening storage in a front-rear direction of the watercraft body.

12. The personal watercraft according to claim 10, wherein the pocket includes an electric power supply connector located inside the pocket.

13. The personal watercraft according to claim 1, wherein the deck further includes an upper-opening storage recessed inward to accommodate items, the upper-opening storage having an opening facing upward.

14. The personal watercraft according to claim 13, wherein a part of the opening of the side-opening storage is located in a region posterior to the upper-opening storage.

15. The personal watercraft according to claim 1, further comprising a side mirror, the side mirror being mounted on the lid.

16. The personal watercraft according to claim 15, wherein with the lid closed, a part of the opening of the side-opening storage is located posterior to the side mirror.

17. The personal watercraft according to claim 1, wherein a part of the opening of the side-opening storage is located in a region posterior to the steering shaft.

18. A personal watercraft comprising:

a watercraft body including a hull and a deck covering an upper portion of the hull;

a handle for steering maneuver;

a steering shaft extending from the handle to the watercraft body, the steering shaft being pivotable relative to the watercraft body in response to the steering maneuver performed using the handle; and a lid, wherein the deck includes a storage including a front portion anterior to the steering shaft and opposite outer side portions outward of the steering shaft in a width direction of the watercraft body, the steering shaft is interposed between the opposite outer side portions of the storage in a plan view of the watercraft body, the lid is configured to cover an opening of the storage, the lid is pivotable about a pivot axis relative to the deck to cover and uncover the opening of the storage, and the pivot axis extends in a direction having a vertical component.

19. A personal watercraft comprising:

a watercraft body including a hull and a deck covering an upper portion of the hull; and a lid, wherein the deck includes a storage recessed inward to accommodate items, the storage having an opening facing an outside environment, the lid is configured to cover the opening of the storage and pivotable about a pivot axis to cover and uncover the opening of the storage, and the pivot axis extends in a direction having both a vertical component and a horizontal component.

* * * * *